US009359109B1

(12) United States Patent
Berwin et al.

(10) Patent No.: US 9,359,109 B1
(45) Date of Patent: Jun. 7, 2016

(54) PALLET SUPPORT BLOCK AND A PALLET CONSTRUCTED WITH PALLET SUPPORT BLOCKS

(71) Applicants: Kevin Joseph Berwin, Chesterfield, MO (US); Michael John Berwin, Wildwood, MO (US); Timothy Joseph Berwin, St. Charles, MO (US); Timothy Oliver Deppen, Urbana, IL (US)

(72) Inventors: Kevin Joseph Berwin, Chesterfield, MO (US); Michael John Berwin, Wildwood, MO (US); Timothy Joseph Berwin, St. Charles, MO (US); Timothy Oliver Deppen, Urbana, IL (US)

(73) Assignee: Palets.com LLC, Chesterfield, MO (US)

( * ) Notice: Subject to any disclaimer, the term of this patent is extended or adjusted under 35 U.S.C. 154(b) by 0 days.

(21) Appl. No.: 14/873,393

(22) Filed: Oct. 2, 2015

(51) Int. Cl.
*B65D 19/38* (2006.01)
*B65D 19/44* (2006.01)

(52) U.S. Cl.
CPC ..... *B65D 19/38* (2013.01); *B65D 19/44* (2013.01); *B65D 2519/00104* (2013.01); *B65D 2519/00373* (2013.01); *B65D 2519/00572* (2013.01); *B65D 2519/00796* (2013.01); *B65D 2519/00815* (2013.01); *B65D 2519/00985* (2013.01)

(58) Field of Classification Search
CPC ..... B65D 19/38; B65D 19/40; B65D 2519/00373
USPC ..... 108/55.1, 56.1, 57.33
See application file for complete search history.

(56) References Cited

U.S. PATENT DOCUMENTS

| | | | | | |
|---|---|---|---|---|---|
| 2,706,099 | A | | 4/1955 | Whalley | |
| 2,754,077 | A | * | 7/1956 | Weber | B65D 19/02 108/55.1 |
| 3,097,741 | A | | 7/1963 | Schwartz | |
| 3,316,861 | A | | 5/1967 | Dailey | |
| 3,407,758 | A | * | 10/1968 | Simkins | B65D 19/0028 108/51.3 |
| 3,598,065 | A | | 8/1971 | Young | |
| 3,804,032 | A | | 4/1974 | Baucom | |
| 3,880,092 | A | | 4/1975 | Seeber et al. | |
| 4,148,394 | A | | 4/1979 | Bederman | |
| 4,240,358 | A | | 12/1980 | Munroe | |
| 4,267,781 | A | * | 5/1981 | Powers | B65D 19/0012 108/56.1 |
| 4,292,900 | A | * | 10/1981 | Bula | B65D 19/0012 108/57.1 |
| 4,317,517 | A | | 3/1982 | Tisdale | |
| 4,671,188 | A | | 6/1987 | Betro et al. | |
| 5,191,843 | A | * | 3/1993 | Ausavich | B65D 19/0026 108/56.1 |
| 5,193,464 | A | | 3/1993 | Morden | |
| 5,197,396 | A | * | 3/1993 | Breezer | B65D 19/0012 108/56.1 |
| 5,388,533 | A | * | 2/1995 | Pigott | B65D 19/0012 108/56.1 |
| 5,413,052 | A | * | 5/1995 | Breezer | B65D 19/0012 108/56.1 |
| 5,555,820 | A | | 9/1996 | Shuert | |

(Continued)

FOREIGN PATENT DOCUMENTS

| | | |
|---|---|---|
| DE | 4242472 | 6/1994 |
| DE | 102006027451 | 12/2007 |

(Continued)

*Primary Examiner* — Daniel Rohrhoff
(74) *Attorney, Agent, or Firm* — Joseph M. Rolnicki; Evans & Dixon, L.L.C.

(57) ABSTRACT

A pallet support block is constructed of recycled plastic material that is also recyclable. The use of the pallet support block in pallet construction reduces the amount of wood used in the pallet construction and thereby makes the pallet lighter and reduces the cost of manufacturing the pallet.

17 Claims, 12 Drawing Sheets

(56) References Cited

U.S. PATENT DOCUMENTS

| | | | | |
|---|---|---|---|---|
| 5,713,289 | A | 2/1998 | Model | |
| 5,830,299 | A | 11/1998 | Teixidor | |
| 5,896,818 | A | 4/1999 | Phillips | |
| 5,960,958 | A | 10/1999 | Michaud et al. | |
| 6,192,807 | B1 | 2/2001 | Mason | |
| 6,210,069 | B1 * | 4/2001 | Speck | B65D 19/18 403/388 |
| 8,813,659 | B2 | 8/2014 | Kuo et al. | |
| 2008/0105168 | A1 * | 5/2008 | Lee | B65D 19/0012 108/56.1 |
| 2011/0192326 | A1 * | 8/2011 | Ingham | B65D 19/0048 108/57.17 |
| 2013/0032507 | A1 | 2/2013 | Du Toit et al. | |
| 2015/0135999 | A1 | 5/2015 | Takyar et al. | |
| 2015/0251804 | A1 * | 9/2015 | Lin | B65D 19/0026 108/56.1 |

FOREIGN PATENT DOCUMENTS

| | | |
|---|---|---|
| DE | 202009007881 | 10/2009 |
| EP | 2783997 | 3/2013 |

* cited by examiner

PALLET SUPPORT BLOCK AND A PALLET CONSTRUCTED WITH PALLET SUPPORT BLOCKS

FIELD

This disclosure pertains to a pallet support block and a pallet constructed with the pallet support block. In particular, the disclosure pertains to a pallet support block that is constructed of recycled plastic material that is also recyclable, and a pallet constructed of the pallet support blocks. The use of the pallet support blocks in the pallet reduces the amount of wood used in the construction of the pallet and thereby makes the pallet lighter, reduces the cost of manufacturing the pallet, reduces the amount of wasted or discarded wood, reduces transportation costs of pallets because the pallet shipping from the manufacturer to the end-user is nestable, and also makes the pallet much lighter which saves fuel.

BACKGROUND

The wood pallet is by far the most commonly used pallet in the United States. FIG. 1 is a representation of a standard North American pallet 10, or a Grocery Manufacturer's Association (GMA) style pallet. The pallet 10 represented in FIG. 1 is constructed of three wood stringers 12. The lengths of the stringers 12 are parallel and spatially positioned across the width of the pallet 10. The stringers are provided with notches 14 in their bottom edges. The notches 14 are dimensioned to accommodate blades of a forklift. The forklift blades are inserted through the notches to enable lifting of the pallet by the forklift. The blades of a forklift can also be inserted between the spatially arranged stringers 12.

A plurality of top deck boards 16 are attached to the top surfaces of the stringers 12 and extend across the stringers. The top deck boards 16 are also constructed of wood. In the pallet 10 represented in FIG. 1, there are five top deck boards 16.

The pallet 10 is also constructed of a plurality of bottom deck boards 18. The bottom deck boards 18 are also constructed of wood. As represented in FIG. 1, the bottom deck boards 18 are attached to the bottom surfaces of the stringers 12 and extend across the stringers.

The wood used in the construction of the pallet 10 makes the pallet heavy, expensive, bulky, and wood intensive. The wood is also susceptible to mold and mildew. Widespread use of the wood in pallets has resulted in environmental problems and waste disposal problems.

SUMMARY

The pallet support block of this disclosure reduces the amount of wood needed to construct a pallet and thereby lowers the cost of constructing a new pallet and lowers the weight of the pallet, reduces fuel consumption and is nestable which allows almost twice as many pallets to ship from the manufacturer to the end-user. The pallet support block is constructed of recycled plastic material, further lowering the cost of the pallet. The support block itself is recyclable. The pallet support block replaces the stringers used in the construction of a pallet and in some applications eliminates the bottom deck boards used in constructing a pallet.

The pallet support block has a center support structure having a height dimension that is larger than a height dimension of a blade of a forklift fork. The center support structure has a tubular center column that provides compression resistant strength to the center support structure. The center support structure also includes first and second sidewalls on opposite sides of the center column. The center support structure further includes first and second webs on opposite sides of the center column. The first and second sidewall and the first and second webs reinforce the center column to resist compression forces.

A top flange is integrally connected with the top of the center support structure. The top flange has a square configuration and projects horizontally outwardly from the top of the center support structure. A top surface of the top flange is flat and smooth. A plurality of underside surface areas are provided on an opposite side of the top flange from the top surface. The plurality of underside surface areas are spatially arranged around the center column of the center support structure. Each underside surface area is configured for receiving a fastener driven through the underside surface area and through the top flange and into a top deck board of a pallet.

A bottom flange is integrally connected with the bottom of the center support structure. The bottom flange has a square configuration that is substantially the same as the configuration of the top flange. The bottom flange projects horizontally outward from the bottom of the center support structure. The bottom flange has a bottom surface. A first slot extends across the bottom surface and a second slot extends across the bottom surface. The first and second slots intersect in a perpendicular orientation. The bottom flange has a plurality of topside surface areas on an opposite side of the bottom flange from the bottom surface. The plurality of topside surface areas are spatially arranged around the center column of the center support structure. Each topside surface area is configured for receiving a fastener driven through the topside surface area and through the bottom flange and into a bottom deck board of a pallet.

In use of the pallet support block in the construction of a pallet, fasteners, such as staples, nails, etc. are driven through the underside surface areas on the top flange of the support block, through the top flange and into the underside of a top deck board of the pallet. In the construction of the pallet, pallet support blocks are secured in this manner to top deck boards of the pallet at the four corners of the pallet. Additional pallet support blocks can be secured to the undersides of top deck boards of the pallet where needed. The support blocks could also be secured to the top deck boards by driving a fastener, such as a nail, through the top deck boards and into a support block.

In a like manner, the bottom flange of the pallet support block is secured to top surface of a bottom deck board of the pallet by fasteners, such as staples, nails, etc. The fasteners are driven through the topside surface areas of the bottom flange, through the bottom flange and into the top surface of the deck board of the pallet. As with the top deck boards, the pallet support blocks are secured to bottom deck boards at the four corners of the pallet. Additional pallet support blocks could be secured to the bottom deck boards if needed.

In the above manner, the wood stringers of a conventional wood pallet are replaced by the pallet support blocks. This reduces the manufacturing cost of the pallet reduces the weight of the pallet, reduces fuel consumption, and also makes the pallets nestable which allows for almost twice as many pallets to ship from the manufacturer to the end-user.

In a variation of the above-described pallet construction, the pallet can be constructed without any bottom deck boards. This leaves the intersecting slots in the bottom surfaces of the pallet support blocks available for positioning straps used to secure goods to the top deck boards of the pallet in the intersecting slots. The intersecting slots prevent the straps from moving off of the pallet support blocks. In addition, the straps that extend across the bottom of the pallet intersect and form a bottom support surface of the pallet that replaces the bottom deck boards. The elimination of the bottom deck boards further reduces the manufacturing costs of the pallet and the weight of the pallet and the transportation costs of the pallet because the pallet shipping from the manufacturer to the end-user is nestable and also much lighter which saves fuel.

BRIEF DESCRIPTION OF THE DRAWING FIGURES

Further features of the pallet support block and the pallet constructed with the pallet support blocks are set forth in the following detailed description and in the drawing figures.

DETAILED DESCRIPTION

Figure 1:
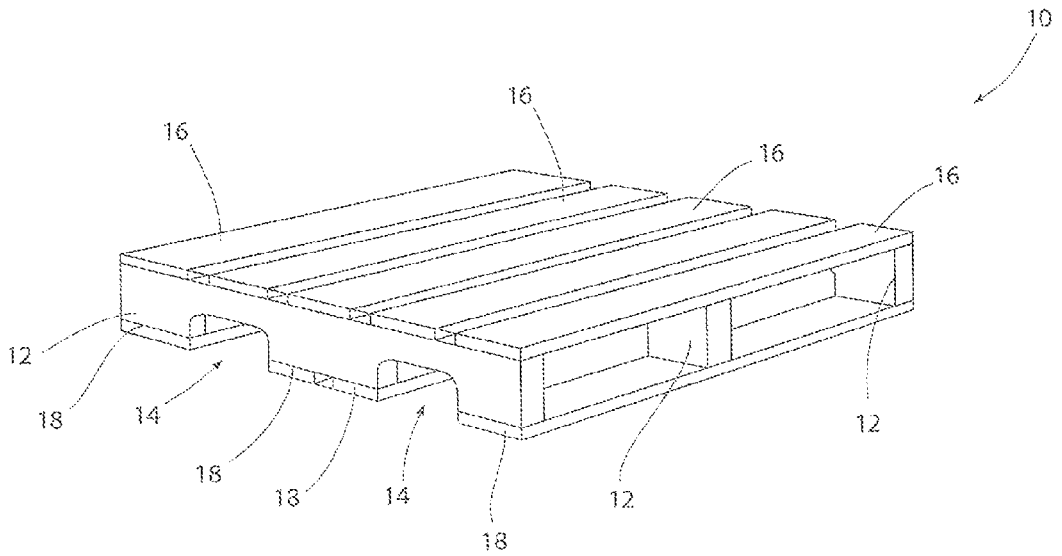
PRIOR ART FIG. 1
FIG. 1 is a representation of a perspective view of a prior art wood pallet.
Figure 2:
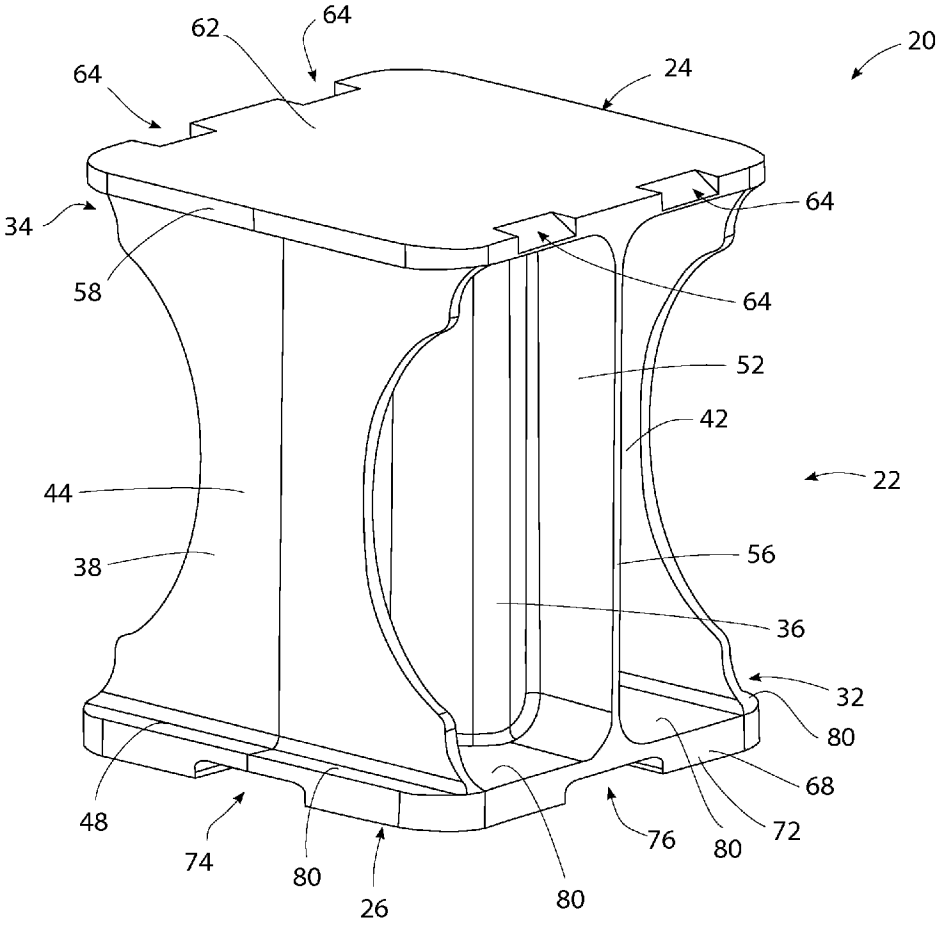
FIG. 2 is a representation of a top perspective view of the pallet support block.
Figure 3:
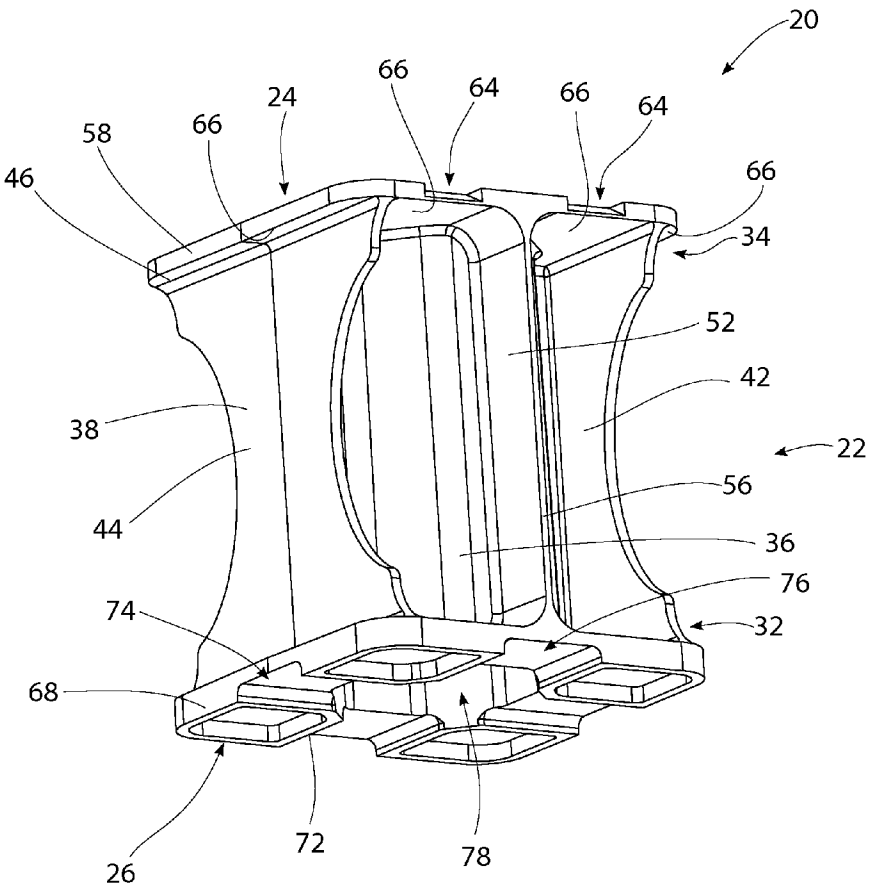
FIG. 3 is a representation of a bottom perspective view of the pallet support block.

The pallet support block 20 of this disclosure is constructed of recycled plastic material or any other equivalent material. Constructed as described herein, the pallet support block 20 is capable of supporting a 750 pound compression load. The block 20 has a substantially cubic configuration. In the illustrative example of this disclosure, the block 20 has a height of approximately 3½ inches, a width of approximately 3 inches and a length of approximately 3 inches. The block 20 is basically comprised of a center support structure 22, a top flange 24 at the top of the support structure 22 and a bottom flange 26 at the bottom of the support structure 22. The center support structure 22, the top flange 24 and the bottom flange 26 are integrally formed as one piece. This reduces the costs of manufacturing the pallet support block 20.

The center support structure 22 of the pallet support block 20 has a vertical height dimension between a bottom 32 of the center support structure 22 and a top 34 of the center support structure 22 that is larger than a height dimension of a blade of a forklift fork. In the illustrative example, the height dimension of the center support structure 22 gives the pallet support block 20 its height of approximately 3½ inches. At the center of the support structure 22 is a tubular column 36. The column 36 provides compression resistant strength to the center support structure 22. In the illustrative example, the column 36 has an octagonal cross-section configuration. This can best be seen in FIG. 6. The column 36 extends between the top flange 24 at the top 34 of the center support structure 22 and the bottom flange 26 at the bottom 32 of the center support structure 22.

Figure 4:
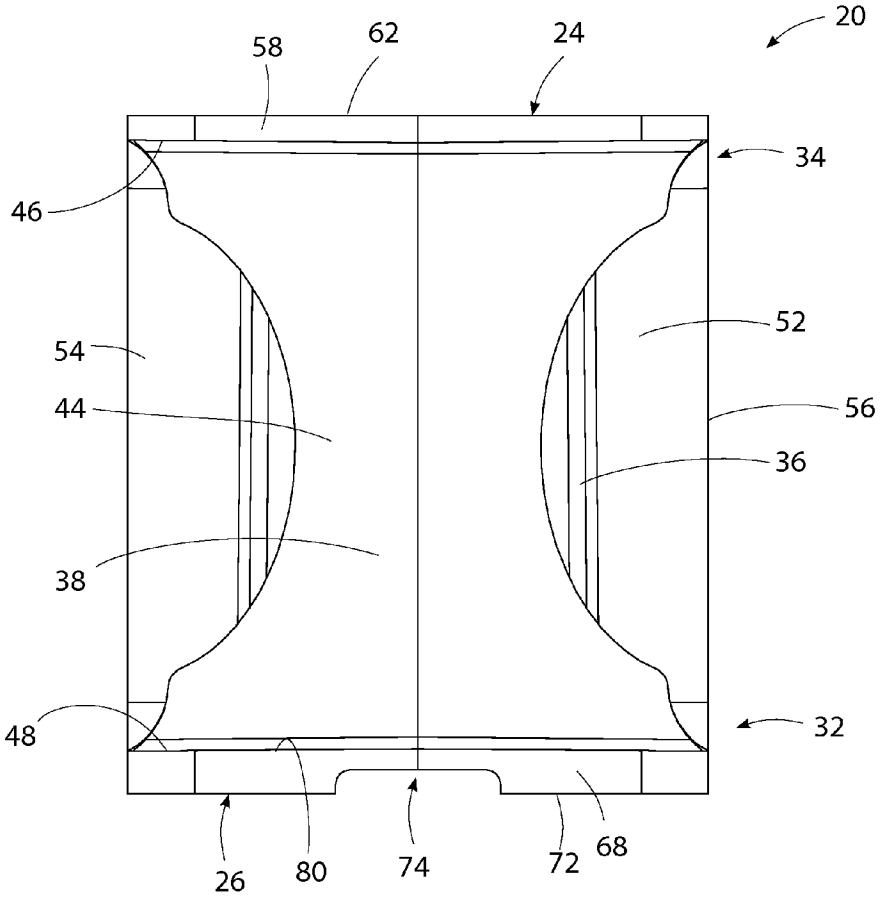
FIG. 4 is a representation of a side elevation view of one side of the pallet support block, the opposite side of the pallet support block being a mirror image thereof.
Figure 5:
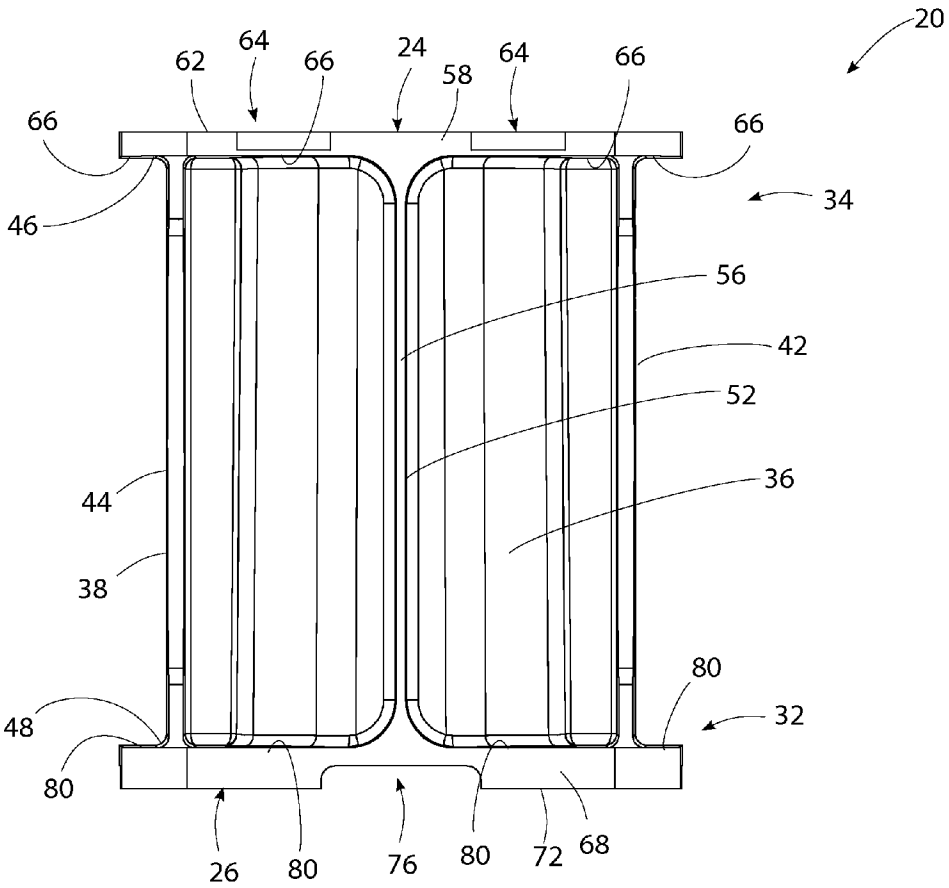
FIG. 5 is a representation of an elevation view of another side of the pallet support block, the opposite side of the pallet support block being a mirror image thereof.

The center support structure 22 also includes first 38 and second 42 side walls integrally formed with the center column 36 on opposite sides of the center column 36. The two side walls 38, 42 are constructed with substantially the same configurations. Because the configurations are substantially the same, the structure of the first side wall 38 is only described in detail herein. It should be understood that the second side wall 42 has the same construction as the first side wall 38. The first side wall 38 is generally planar and extends vertically between the top flange 24 and the bottom flange 26. An intermediate portion 44 of the first side wall 38 has a smaller width dimension. The width dimension of the first side wall 38 increases as the first side wall 38 extends from the intermediate portion 44 to the top flange 24 and as the first side wall 38 extends from the intermediate portion 44 to the bottom flange 26. As represented in FIG. 4, a top edge 46 of the first side wall 38 extends completely across the top flange 24 and a bottom edge 48 of the first side wall 38 extends completely across the bottom flange 26. The top flange 24, the bottom flange 26, the column 36 and the first side wall 38 are all integrally connected as one piece. The configurations of the first side wall 38 and the second side wall 42 reinforce the center column 36 to resist compression forces on the top flange 24 that may not be centered relative to the top flange.

The center support structure 22 further includes first 52 and second 54 webs integrally formed with the center column 36 on opposite sides of the center column. The first web 52 and second web 54 have configurations that are substantially the same. Therefore, only the structure of the first web 52 is described in detail herein. It should be understood that the second web 54 has the same construction as the first web 52. As represented in FIGS. 2-6, the first web 52 is generally planar and extends vertically between the top flange 24 and the bottom flange 26, and also projects or extends horizontally outwardly from the center column 36. The first web 52 extends outwardly to an edge 56 of the first web 52. The edge 56 of the first web 52 extends vertically straight between an outer edge of the top flange 24 and an outer edge of the bottom flange 26. The configurations of the first web 52 and the second web 54 provide further reinforcement to the center column 36 to resist compression forces exerted on the pallet support block 20 that may not be centered relative to the top flange 24.

The two side walls 38, 42 and the two webs 52, 54 each have a draft. This means that the side walls 38, 42 and the webs 52, 54 are thicker where they are adjacent the column 36 and become thinner as they extend away from the column 36. This feature enables the pallet support block 20 to be easily separated in an injection mold.

The top flange 24 is integrally connected with the top 34 of the center support structure 22. The top flange 24 has a rectangular configuration, and in the illustrative example the configuration of the top flange 24 is substantially square. The top flange 24 projects horizontally outwardly from the center support structure 22 to an outer edge 58 of the top flange 24 that is generally square. A top surface 62 of the top flange 24 that is opposite the center support structure 22 is generally flat, continuous and smooth. Pairs of notches 64 are formed in the top flange outer edge 58 on opposite sides of the top flange top surface 62. The pairs of notches 64 are provided to enable insertion of a prying tool between the top flange top surface 62 and a top deck board of a pallet when removing the support block 20 from the top deck board. A plurality of underside surface areas 66 are provided on the top flange 24 on an opposite side of the top flange 24 from the top surface 62. In the illustrative example of the pallet support block 20, there are seven such underside surface areas 66. Two of the underside surface areas 66 are positioned between the first 38 and second 42 side walls and the outer edge 58 of the top flange 24. Two of the underside surface areas 66 are also positioned on opposite sides of the first web 52 and the second web 54. One underside surface area is positioned inside the column 36 on the opposite side of the top surface 62. The plurality of underside surface areas 66 are spatially arranged around the center column 36 and inside the support column of the center support structure 22. Each of the underside surface areas 66 is configured for receiving a fastener (for example a staple, a wood screw, or other equivalent fastener) driven through the underside surface area 66, through the top flange 24 and into a top deck board of a pallet.

Figure 6:
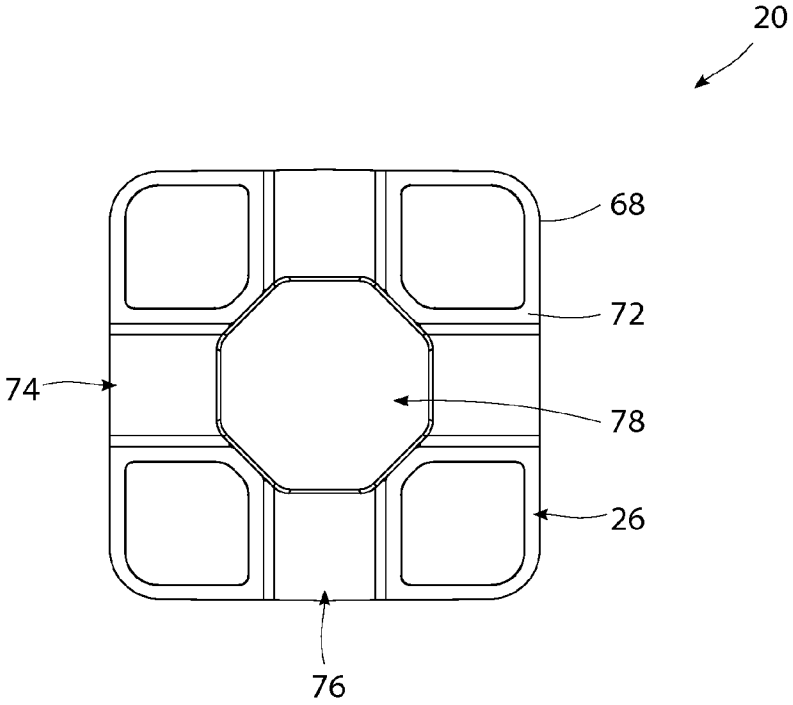
FIG. 6 is a representation of a bottom plan view of the pallet support block.

The bottom flange 26 is integrally connected with the bottom 32 of the center support structure 22. The bottom flange 26 has a rectangular configuration that is substantially the same as the configuration of the top flange 24. In the illustrative example, the configuration of the bottom flange 26 is substantially square. The bottom flange 26 projects horizontally outwardly from the center support structure 22 to an outer edge 68 of the bottom flange 26 that is generally square. The bottom flange 26 has a bottom surface 72 that is on an opposite side of the bottom flange 26 from the center support structure 22. A first slot 74 is recessed into the bottom flange bottom surface 72 and extends across the middle of the bottom surface 72 to the outer edge 68 of the bottom flange. A second slot 76 is also recessed into the bottom flange bottom surface 72 and extends across the middle of the bottom surface 72 to the bottom flange outer edge 68. The first 74 and second 76 slots have a perpendicular orientation. The first 74 and second 76 slots have width dimensions that enable straps that secure goods to a pallet constructed with the pallet support blocks 20 to be received in the slots 74, 76. The slots 74, 76 also are accessible at the bottom flange outer edge 68 for receiving a prying tool when removing the pallet support block 20 from a bottom deck board of a pallet. As represented in FIG. 6, the first slot 74 and second slot 76 intersect at an opening 78 to the interior of the tubular center column 36 of the center support structure 22. The opening 78 has an octagonal configuration due to the octagonal cross-section configuration of the center column 36. Like the top flange 24, the bottom flange 26 has a plurality of topside surface areas 80 on an opposite side of the bottom flange 26 from the bottom surface 72. In the illustrative example of the pallet support block 20, there are six topside surface areas 80. Two of the topside surface areas 80 are positioned between the first side wall 38 and second side wall 42 and the bottom flange outer edge 68. Two of the topside surface areas 80 are also positioned on opposite sides of the first web 52 and the second web 54. The topside surface areas 80 are spatially arranged around the center column 36 of the center support structure 22. Each topside surface area 80 is configured for receiving a fastener for example a staple, a wood screw or other equivalent type of fastener driven through the topside surface area 80, through the bottom flange 26 and into a bottom deck board of a pallet.

Figure 7:
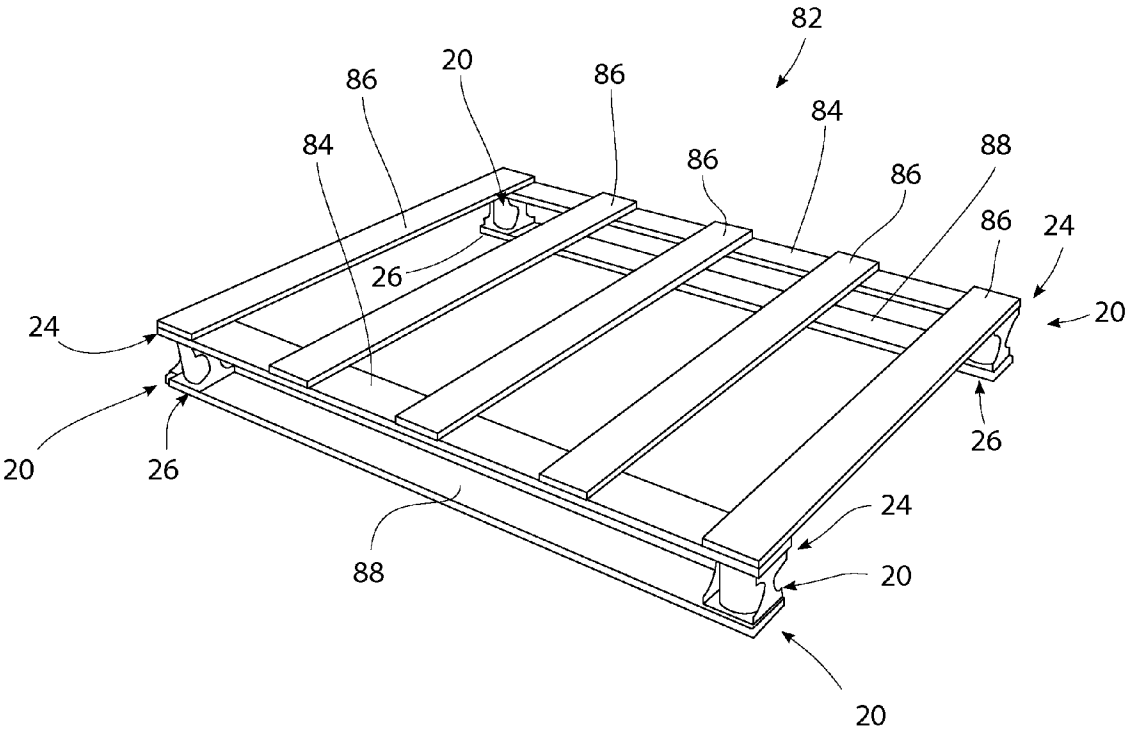
FIG. 7 is a representation of a pallet constructed with pallet support blocks.
Figure 11:
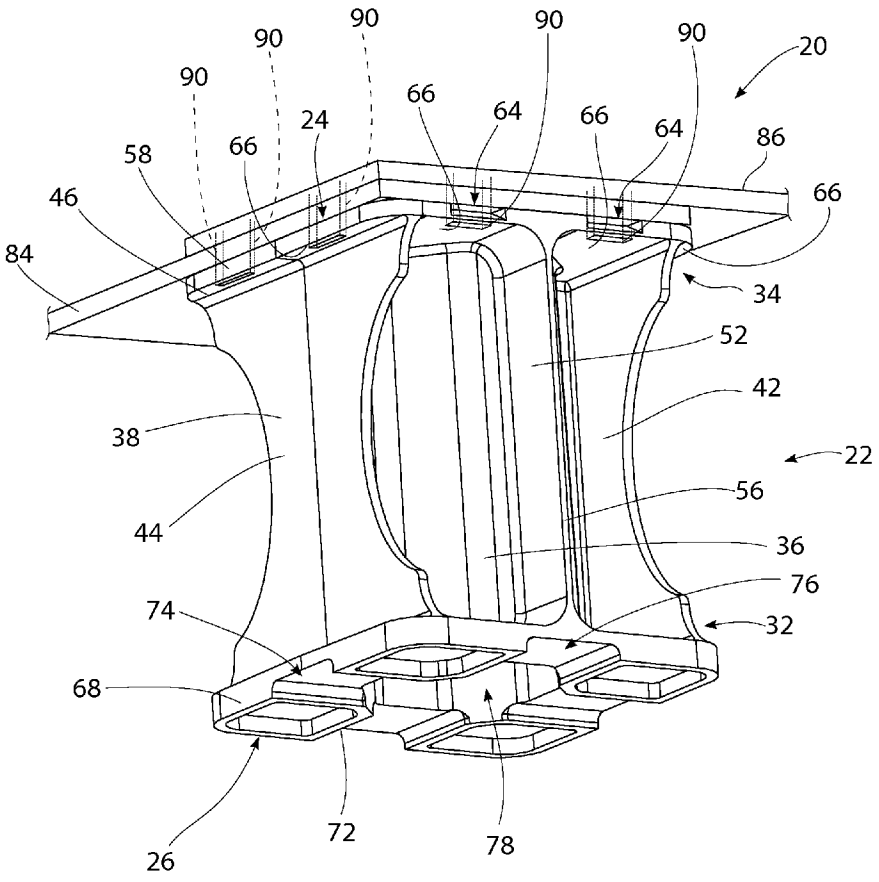
FIG. 11 is a partial view of the pallet of FIG. 7.

FIG. 7 is a representation of a pallet 82 constructed using the pallet support block 20 of this disclosure. The pallet 82 is comprised of a pair of top end boards 84, five top deck boards 86 and a pair of bottom end boards 88. The pallet 82 employs four support blocks 20 at the four corners of the pallet. In constructing the pallet 82, fasteners 90, such as staples, nails, etc. are driven through the underside surface areas 66 of the top flange 24 of each of the support blocks 20, through the top flange 24 and into the undersides of the top end boards 84. FIG. 11 is a partial view of the pallet shown in FIG. 7 showing the positioning of the fasteners 90 in the top flange 24. The fasteners could also be driven through the top end boards 84 and into the top deck boards 86 above each of the pallet support blocks 20.

Figure 12:
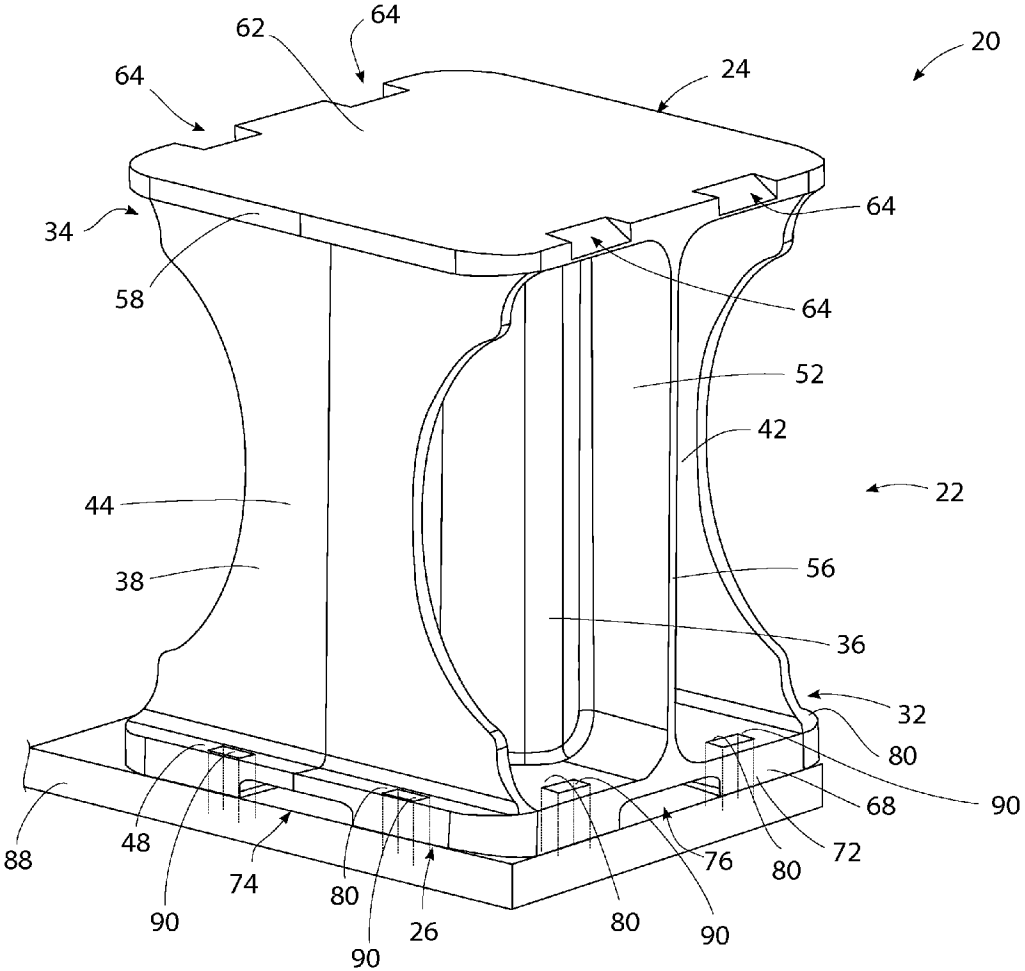
FIG. 12 is a partial view of the pallet of FIG. 7.

In a like manner, the bottom flanges 26 of the pallet support blocks 20 are secured to the top surfaces of the bottom end boards 88 of the pallet 82 by fasteners 90, such as staples, nails, etc. The fasteners 90 are driven through the topside surface areas 80 of the bottom flanges 26, through the bottom flanges 26 and into the bottom end boards 88 of the pallet 82. FIG. 12 is a partial view of the pallet shown in FIG. 7 showing the positioning of the fasteners 90 in the bottom flange 26. As with the top end boards 84 and top deck boards 86, the pallet support blocks 20 are secured to the bottom end boards 88 at the four corners of the pallet 82. Additional support blocks 20 could be secured between the top end boards 84 and the bottom end boards 88 if needed.

Figure 8:
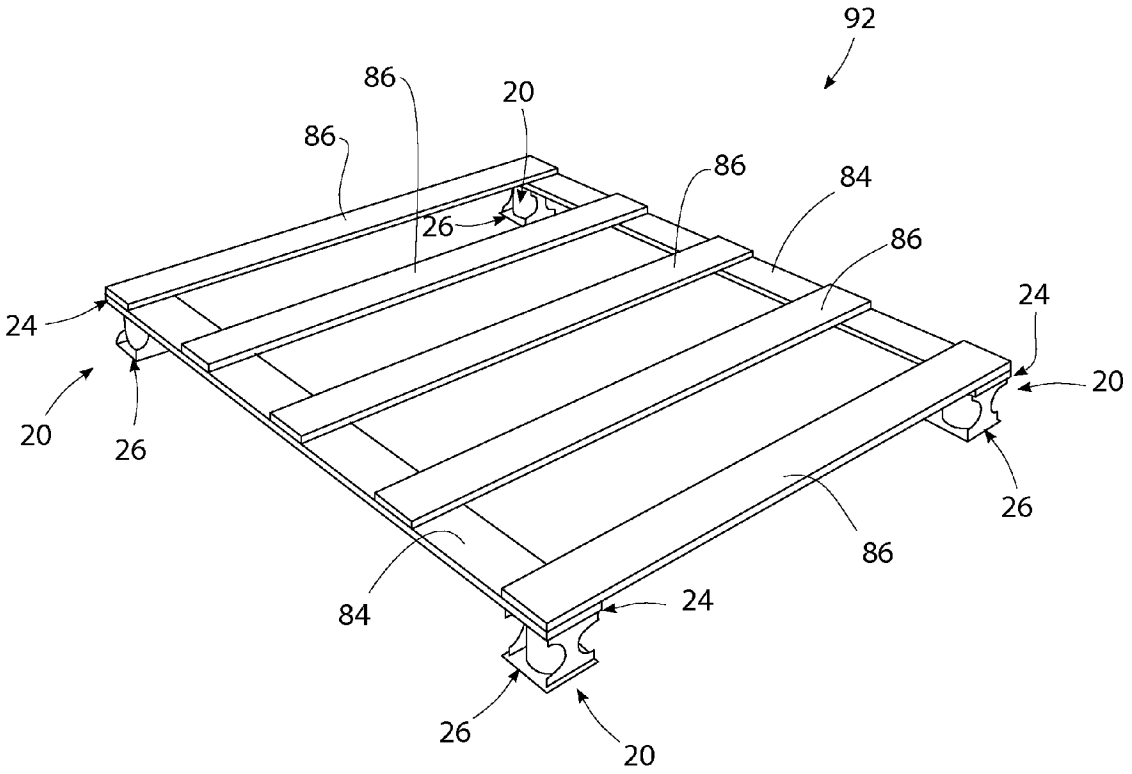
FIG. 8 is a representation of a variation of a pallet constructed with the pallet support blocks.

FIG. 8 is a representation of a pallet 92 that has basically the same construction as the pallet of FIG. 7, but without the bottom end boards 88. The pallet 92 of FIG. 8 is constructed in substantially the same manner as the pallet 82 of FIG. 7, and therefore will not be further described. The reference numbers employed in FIG. 7 to describe the pallet 82 construction are also employed in the construction of the pallet 92 of FIG. 8.

Figure 9:
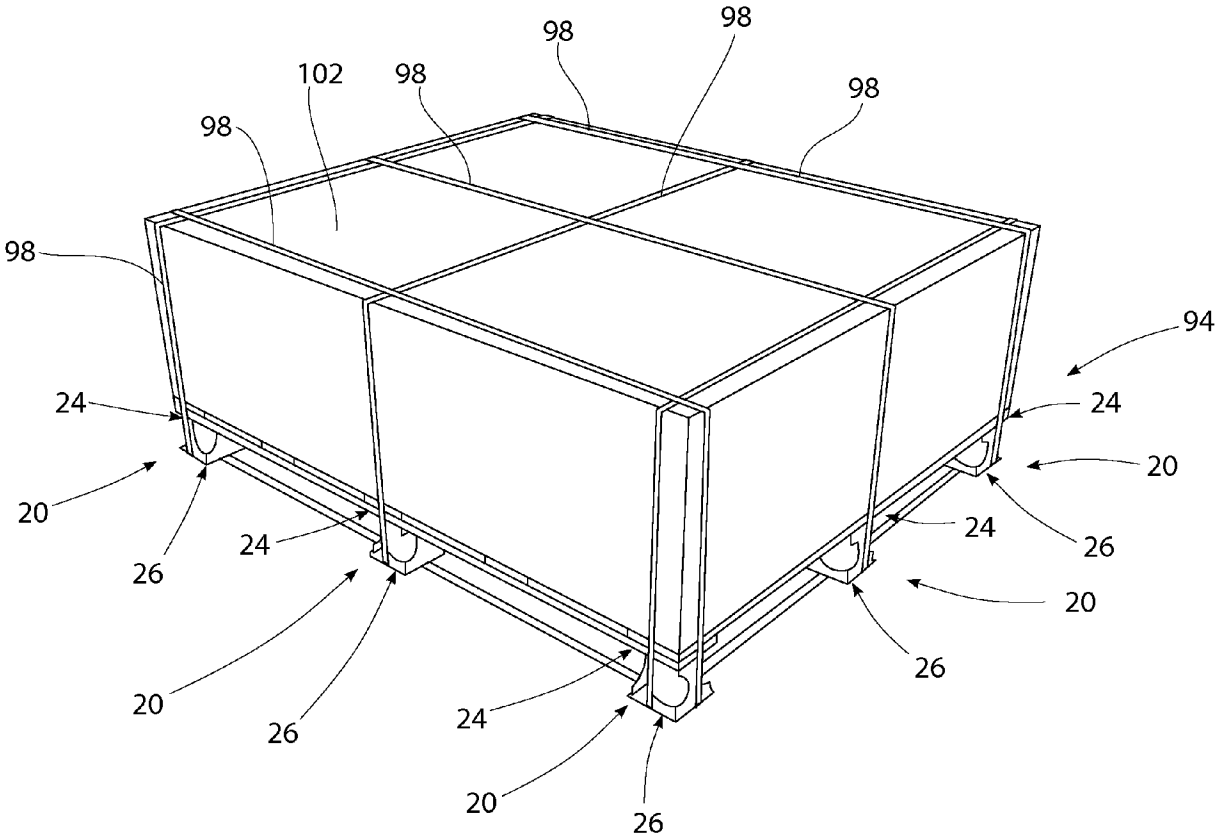
FIG. 9 is a representation of a further variation of a pallet constructed with the pallet support blocks.
Figure 10:
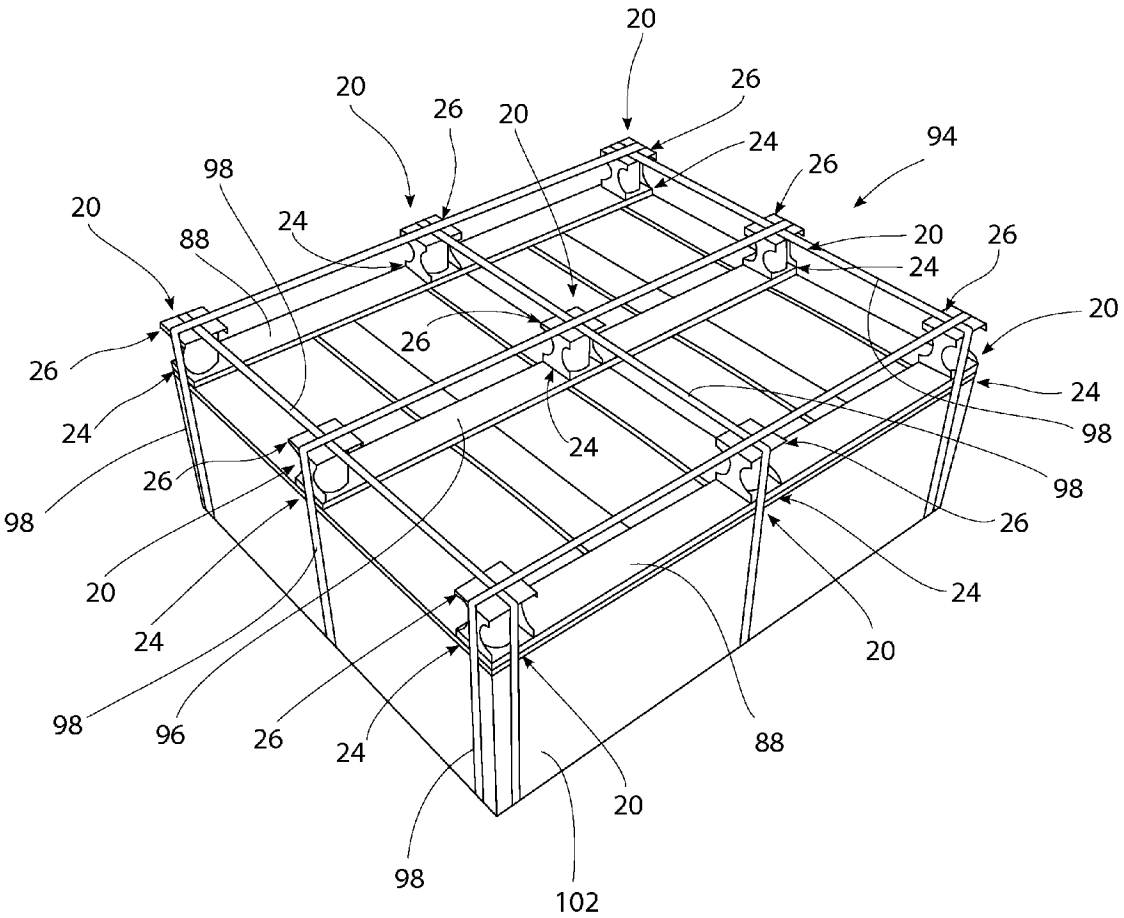
FIG. 10 is a representation of a bottom view of the pallet constructed with the pallet support blocks represented in FIG. 9.

FIGS. 9 and 10 show representations of a pallet 94 having a construction similar to that of the pallet of FIG. 8. Reference numbers employed in describing the constructions of the pallets 82 of FIG. 7 and the pallet 92 of FIG. 8 are also employed in describing the construction of the pallet 94 of FIGS. 9 and 10. In addition to the top end stringer boards 84 of the pallet 82 of FIG. 7, the pallet 94 of FIGS. 9 and 10 employs a top center stringer board 96. The top deck boards 86 extend across the top center stringer board 96 to the opposite top end boards 84. The top flanges 24 of nine pallet support blocks 20 are secured to the intersections of the top deck boards 86 with the top center board 96 and the top end stringer boards 84 in the same manner described earlier. In addition, in the pallet 94 of FIGS. 9 and 10, six straps 98 are employed to secure goods 102 to the top of the pallet 94. Referring to the bottom of the pallet 94 represented in FIG. 10, it can be seen that the six straps 102 are received in the first slot 74 and second slot 76 of each of the pallet support blocks 20. The engagement of the straps 98 in the first slots 74 and second slots 76 prevents the straps from moving off of the bottom flanges 26 of each of the pallet support blocks 20. Additionally, the straps 98 criss-cross and extend across the bottom of the pallet 94. The criss-crossing straps 98 and the portions of the straps that extend between each of the pallet support blocks 20 form a support surface. The support surface provided by the straps 98 enable the pallet 94 of FIGS. 9 and 10, to be moved along a roller conveyor or other similar type of conveyance device, even though the pallet 94 employs no bottom deck boards. The bottom deck boards are replaced by the portions of straps 98 that criss-cross across the bottom of the pallet 94 and extend between the pallet support blocks 20 of the pallet 94. The elimination of the bottom deck boards further reduces the manufacturing costs of the pallet 94 and the weight of the pallet.

The pallet support block 20 of this disclosure when used in the construction of a pallet reduces the amount of wood used in the construction of the pallet. They thereby reduce the costs of manufacturing a pallet and reduce wood waste. They make the pallet lightweight, which saves fuel in transporting goods on the pallet. When employing the pallet support blocks 20 in the construction of a pallet such as those represented in FIGS. 7-10, two pallets can be inverted when stacked for storage, thereby lowering the amount of storage space needed. The pallet support blocks 20 are also recyclable and can be easily removed from a pallet construction by prying the pallet support blocks 20 from the pallet and recycling the support block, as well as recycling the wood of the pallet. The pallet support blocks 20 will not absorb water, or allow any bacterial to grow on the pallet support blocks.

As various modifications could be made in the construction of the apparatus and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

What is claimed:

1. A pallet support block comprising:

a center support structure having a top and a bottom at opposite ends of the center support structure, the center support structure having a vertical height dimension between the top and bottom of the center support structure that is larger than a height dimension of a blade of a forklift fork;

a top flange projecting horizontally outward from the top of the center support structure, the top flange having an underside surface area that is configured for receiving a fastener driven through the underside surface area and the top flange and into a top board of a pallet;

a bottom flange projecting horizontally outward from the bottom of the center support structure, the bottom flange having a topside surface area that is configured for receiving a fastener driven through the topside surface area and the bottom flange and into a bottom board of a pallet;

the underside surface area of the top flange being one underside surface area of a plurality of underside surface areas on the top flange, each underside surface area of the plurality of underside surface areas on the top flange is configured for receiving a fastener driven through the underside surface area and the top flange and into a top board of a pallet;

the topside surface area of the bottom flange being one topside surface area of a plurality of topside surface areas on the bottom flange, each topside surface area of the plurality of topside surface areas on the bottom flange is configured for receiving a fastener driven through the topside surface area and the bottom flange and into a bottom board of a pallet;

the center support structuring having a center column that extends between the top and bottom of the center support structure, the center column is connected to the top flange and the bottom flange;

the plurality of underside surface areas on the to flange are spatially arranged around the center column and the plurality of topside surface areas on the bottom flange are spatially arranged around the center column;

the bottom flange having a bottom surface on an opposite side of the bottom flange from the center support structure;

a first slot recessed into the bottom surface of the bottom flange, the first slot extending completely across the bottom surface of the bottom flange; and, a second slot recessed into the bottom surface of the bottom flange, the second slot extending completely across the bottom surface of the bottom flange; and, the first slot and the second slot intersect at a perpendicular orientation.

2. The pallet support block of claim 1, further comprising:

the center column being tubular.

3. The pallet support block of claim 1, further comprising:

the center column having an octagonal cross-section configuration.

4. The pallet support block of claim 1, further comprising:

the center support structure having a first sidewall and a second sidewall on opposite sides of the center column, both the first sidewall and the second sidewall extend between the top and bottom of the center support structure, and the first sidewall and the second sidewall are attached to the top flange and the bottom flange.

5. The pallet support block of claim 4, further comprising:

the center support structure includes a first web and a second web that extend between the top and bottom of the center support structure, the first web and the second web are attached to the top flange and the bottom flange, and the first web and the second web project horizontally outward from opposite sides of the center column.

6. The pallet support block of claim 1, further comprising:

a top board of a pallet removably attached to the top flange.

7. The pallet support block of claim 6, further comprising:

a bottom board of a pallet removably attached to the bottom flange.

8. The pallet support block of claim 1, further comprising:

a first strap extending through the first slot; and, a second strap extending through the second slot.

9. A pallet support block comprising:

a center support structure having a top and a bottom at opposite ends of the center support structure, the center support structure having a vertical height dimension between the top and bottom of the center support structure that is larger than a height dimension of a blade of a forklift fork;

a top flange projecting horizontally outward from the top of the center support structure, the top flange having a top surface on the top flange that is on an opposite side of the top flange from the center support structure;

a bottom flange projecting horizontally outward from the bottom of the center support structure, the bottom flange having a bottom surface on the bottom flange that is on an opposite side of the bottom flange from the center support structure;

a first slot recessed into the bottom surface of the bottom flange, the first slot extending completely across the bottom surface of the bottom flange;

a second slot recessed into the bottom surface of the bottom flange, the second slot extending completely across the bottom surface of the bottom flange; and, the first slot and the second slot intersecting at a perpendicular orientation.

10. The pallet support block of claim 9, further comprising:

a first strap extending through the first slot; and, a second strap extending through the second slot.

11. The pallet support block of claim 9, further comprising:

a plurality of underside surface areas on the top flange, each underside surface area of the plurality of underside surface areas on the top flange is configured for receiving a fastener driven through the underside surface area and the top flange and into a top board of a pallet.

12. The pallet support block of claim 11, further comprising:

a plurality of topside surface areas on the bottom flange, each topside surface area of the plurality of topside surface areas on the bottom flange is configured for receiving a fastener driven through the topside surface area and the bottom flange and into a bottom board of a pallet.

13. The pallet support block of claim 11, further comprising:

the center support structure having a center column that extends between the top and bottom of the center support structure, the center column is connected to the top flange and the bottom flange; and, the plurality of underside surface areas on the top flange are spatially arranged around the center column and the plurality of topside surface areas on the bottom flange are spatially arranged around the center column.

14. The pallet support block of claim 13, further comprising:

the center column being tubular.

15. The pallet support block of claim 13, further comprising:

the center support structure having a first sidewall and a second sidewall on opposite sides of the center column, both the first sidewall and the second sidewall extend between the top and bottom of the center support structure, and the first sidewall and the second sidewall are attached to the top flange and the bottom flange.

16. The pallet support block of claim 15, further comprising:

the center support structure includes a first web and a second web that extend between the top and bottom of the center support structure, the first web and the second web are attached to the top flange and the bottom flange, and the first web and the second web project horizontally outward from opposite sides of the center column.

17. The pallet support block of claim 9, further comprising:

a top board of a pallet removably attached to the top flange.

* * * * *